US006757981B2

(12) United States Patent
Hampton

(10) Patent No.: US 6,757,981 B2
(45) Date of Patent: Jul. 6, 2004

(54) UNIVERSAL RIP GUIDE FOR CIRCULAR SAW

(76) Inventor: Philip W. Hampton, 28203 Turtle Rock Rd., Valley Center, CA (US) 92082

( * ) Notice: Subject to any disclaimer, the term of this patent is extended or adjusted under 35 U.S.C. 154(b) by 47 days.

(21) Appl. No.: 10/197,466

(22) Filed: Jul. 19, 2002

(65) Prior Publication Data

US 2004/0010926 A1 Jan. 22, 2004

(51) Int. Cl.[7] ..... B27B 9/04

(52) U.S. Cl. ..... 30/372; 30/373; 83/745; 33/42

(58) Field of Search ..... 30/371, 372, 373, 30/374, 375; 83/743, 745, 574; 33/32.1, 32.2, 42, 630, 631

(56) References Cited

U.S. PATENT DOCUMENTS

| | | | | | |
|---|---|---|---|---|---|
| 1,911,045 | A | * | 5/1933 | Tinnen | 83/574 |
| 2,676,624 | A | | 4/1954 | Gecmen | 143/43 |
| 2,773,523 | A | | 12/1956 | Hopla | 143/6 |
| 2,800,933 | A | | 7/1957 | Michael | 143/43 |
| 2,819,742 | A | * | 1/1958 | Blachly | 30/373 |
| 3,045,724 | A | * | 7/1962 | Mitchell | 83/574 |
| 3,927,475 | A | * | 12/1975 | Chang | 33/42 |
| 4,128,940 | A | | 12/1978 | Ong | 30/373 |
| 4,356,748 | A | | 11/1982 | Tilton | 83/745 |
| 4,453,312 | A | | 6/1984 | Nishioka | 30/372 |
| 4,483,071 | A | * | 11/1984 | te Kolste | 33/42 |
| 4,602,435 | A | | 7/1986 | Nishioka | 30/372 |
| 4,628,608 | A | * | 12/1986 | Kuhlmann et al. | 30/373 |
| 4,751,865 | A | | 6/1988 | Buckalew | 83/745 |
| 4,852,257 | A | | 8/1989 | Moore | 30/373 |
| 4,945,799 | A | | 8/1990 | Knetzer | 83/745 |
| 5,035,061 | A | * | 7/1991 | Bradbury et al. | 30/373 |
| 5,103,566 | A | | 4/1992 | Stebe | 33/42 |
| 5,279,037 | A | | 1/1994 | Leatherman | 30/373 |
| 5,649,366 | A | | 7/1997 | Scheiman | 30/374 |
| 5,815,931 | A | | 10/1998 | Cleveland | 30/373 |
| 5,815,933 | A | | 10/1998 | Staniszewski | 30/376 |
| 5,901,450 | A | | 5/1999 | James | 30/373 |
| 6,216,355 | B1 | * | 4/2001 | Darnell | 33/630 |

* cited by examiner

*Primary Examiner*—Stephen Choi
(74) *Attorney, Agent, or Firm*—Fitch, Even, Tabin & Flannery

(57) ABSTRACT

A handheld circular saw incorporating an improved rip guide is illustrated which guarantees accurate cuts in the ripping of sheet workpieces. The guide is precisely clamped to the upper surface of a foot assembly of the circular saw. A guide member is slidably movable along the longitudinal length of a bar section of the guide and securely locked in a desired position where it assures that a workpiece can be cut to a precise width desired, as a result of the accuracy of alignment of a flat surface of the guide member which is precisely parallel to the plane of the circular saw blade, that is then moved flush along an edge of the workpiece being ripped.

13 Claims, 4 Drawing Sheets

UNIVERSAL RIP GUIDE FOR CIRCULAR SAW

FIELD OF THE INVENTION

The invention relates to handheld circular saws, and more particularly to a rip guide designed for incorporation with such a handheld circular saw.

BACKGROUND OF THE INVENTION

It has long been necessary to trim sheets of building materials, for example the standard 4'×8' sheet of plywood, wood paneling or gypsum wall board, to a precise width; for carpenters working on the job, the handheld circular saw is the tool of choice for such a trimming operation. To provide a precise straight edge at the cut or trimmed location, a number of different types of guides for such circular saws have been proposed. Examples of some these are shown in the following U.S. Pat. Nos. 2,676,624, 2,773,523, 2,800,933, 4,128,940, 4,356,748, 4,453,312, 4,852,257, 4,945,799, 5,103,566, 5,279,037, 5,815,931, 5,815,933, and 5,901,450.

Although of each of the foregoing has had particular advantages and although the variety of guides available have varied in complexity, no one guide has been widely accepted, i.e. as one that is capable of economical construction while yet being universally suited to precisely trim a large range of materials. Accordingly, improved constructions for a rip guide for a handheld circular saw were sought.

SUMMARY OF THE INVENTION

The invention provides a handheld circular saw which incorporates an improved rip guide, as well as a rip guide itself which can be incorporated with commercially available circular saws. Such handheld circular saws incorporate an electric motor disposed within a housing, which rotates a shaft to which the circular saw blade is attached, with the housing being adjustably supported on a flat plate which rests against the flat surface of the piece being trimmed, and the guide is removably attached to the upper surface of the flat foot assembly. The adjustable guide includes a longitudinally extending elongated flat bar which is stepped at a location intermediate its length to provide flat upper and lower sections which are in straight-line alignment. Means is provided for mounting the flat upper bar section upon the upper surface of the circular saw foot assembly so that the longitudinally extending bar is precisely parallel to the axis about which the circular saw rotates, with its stepped portion in abutting contact with an edge of the circular saw foot assembly. A holder is slidably movable along the lower bar in such a manner that a guide member carried below the holder (which includes straight-line defining means, e.g. a flat surface, that will be slid along the edge of the workpiece being trimmed) is maintained at a precise distance from and precisely parallel to the plane in which the circular saw blade rotates.

The invention provides a particularly compact universal rip guide for a handheld circular saw which is capable of facilitating accurate and true cuts and which saves the user immeasurable time in a situation where there is a desire to make repetitive cuts of a precise nature.

DETAILED DESCRIPTION OF THE PREFERRED EMBODIMENTS

Figure 1:
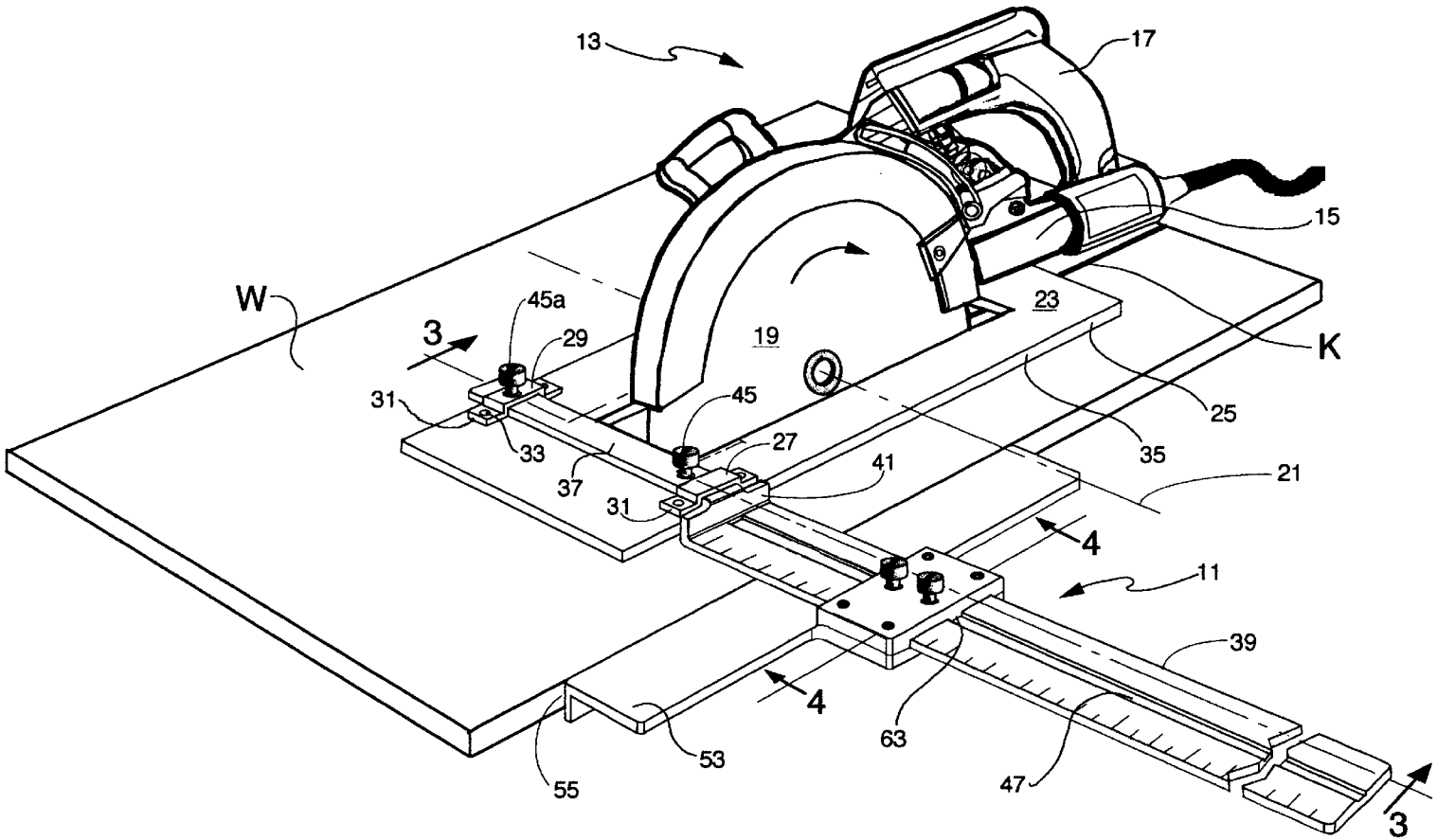
FIG. 1 is a perspective view showing a circular saw and rip guide combination embodying various features of the invention in use as it might be employed to trim a flat sheet of material.

Illustrated in FIG. 1 is a rip guide 11 in combination with a circular saw 13. The circular saw 13 contains a housing 15 and motor (not shown) and includes a hand grip and trigger 17. The motor drives a saw blade 19 on a shaft (not shown) that rotates about an axis 21 which is parallel to an upper surface 23 of a foot assembly or support plate 25 on which the housing 15 is preferably adjustably mounted so as to facilitate changing the depth which the blade will cut below the undersurface of the foot assembly 25.

The purpose of the rip guide 11 is to facilitate the cutting of a precisely straight kerf K in a workpiece W along the top surface of which the circular saw is slid, with the flat undersurface of the foot assembly 25 resting on the flat upper surface of the workpiece W. The usual workpieces being cut or trimmed will be sheets of construction material, such as plywood, wood paneling, sheet rock or Gypsum wallboard, chipboard sheets and the like; however, it can be seen that the rip guide is designed to facilitate cutting a straight edge precisely parallel to the existing straight edge of a panel or sheet of substantially any flat material.

The rip guide 11 is removably secured to the foot assembly 25 of the circular saw through a pair of inverted, generally U-shaped brackets 27 that are suitably affixed to the upper surface 23 of the foot assembly. The brackets 27 include a central section 29 in the form of an inverted U, flanked by a pair of flanges 31. The flanges 31 are suitably affixed to the upper surface 23 of the foot assembly to provide a pair of channels that slidably receive the corresponding portion of the universal rip guide. The flanges may be affixed to the standard steel foot assembly 25 of a circular saw in any suitable manner, as by welding or as shown by rivets or screws 33 or the like. The actual securing of the guide against the foot assembly 25 is described in more detail hereinafter.

Figure 2:
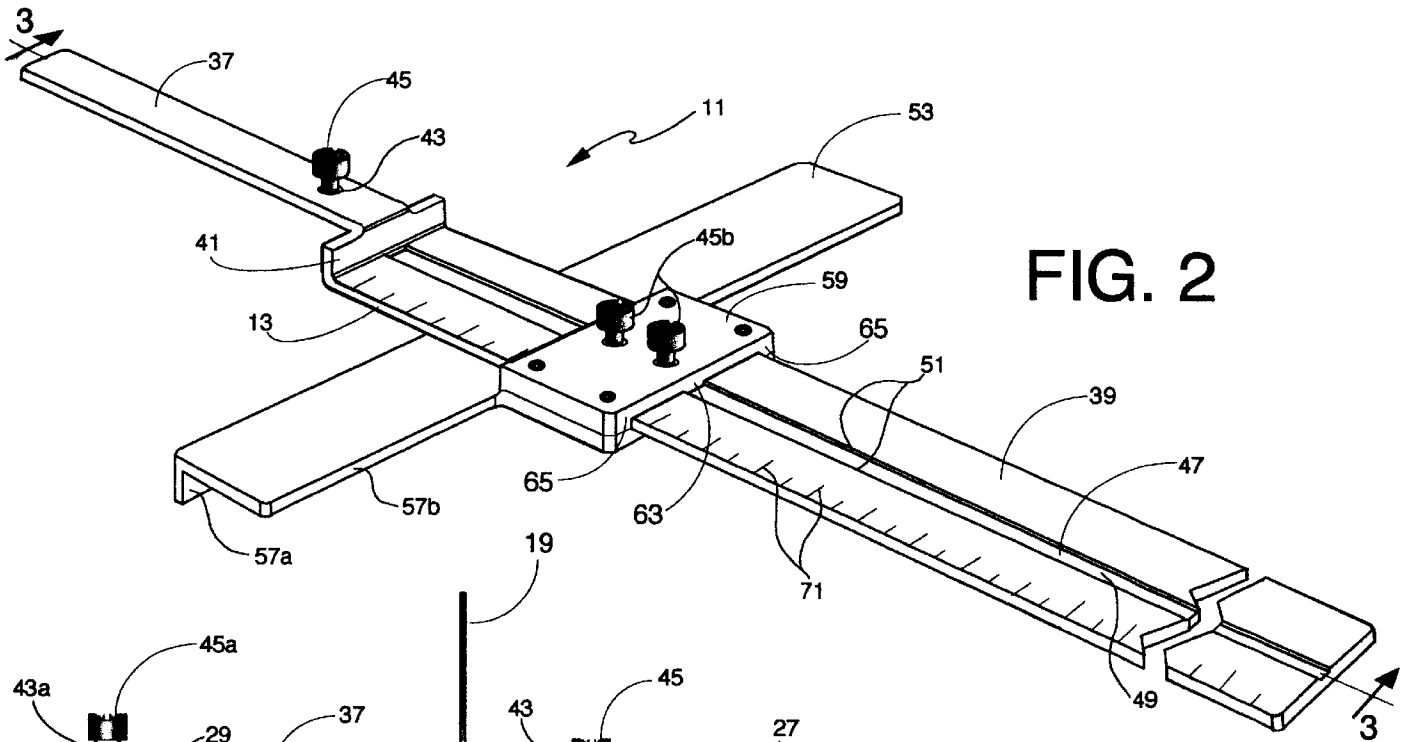
FIG. 2 is a perspective view, enlarged in size, of the guide shown in FIG. 1.
Figure 3:
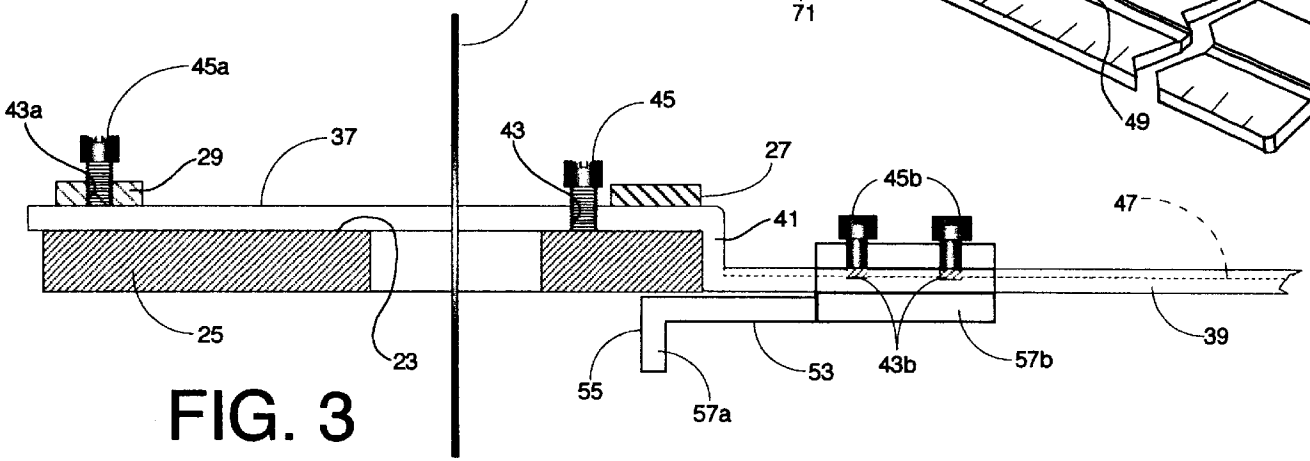
FIG. 3 is a sectional view, enlarged in size, taken generally along the line 3—3 of in FIG. 1, showing the saw foot assembly and the saw blade schematically, with some of the elements of the rip guide being shown in elevation.
Figure 5:
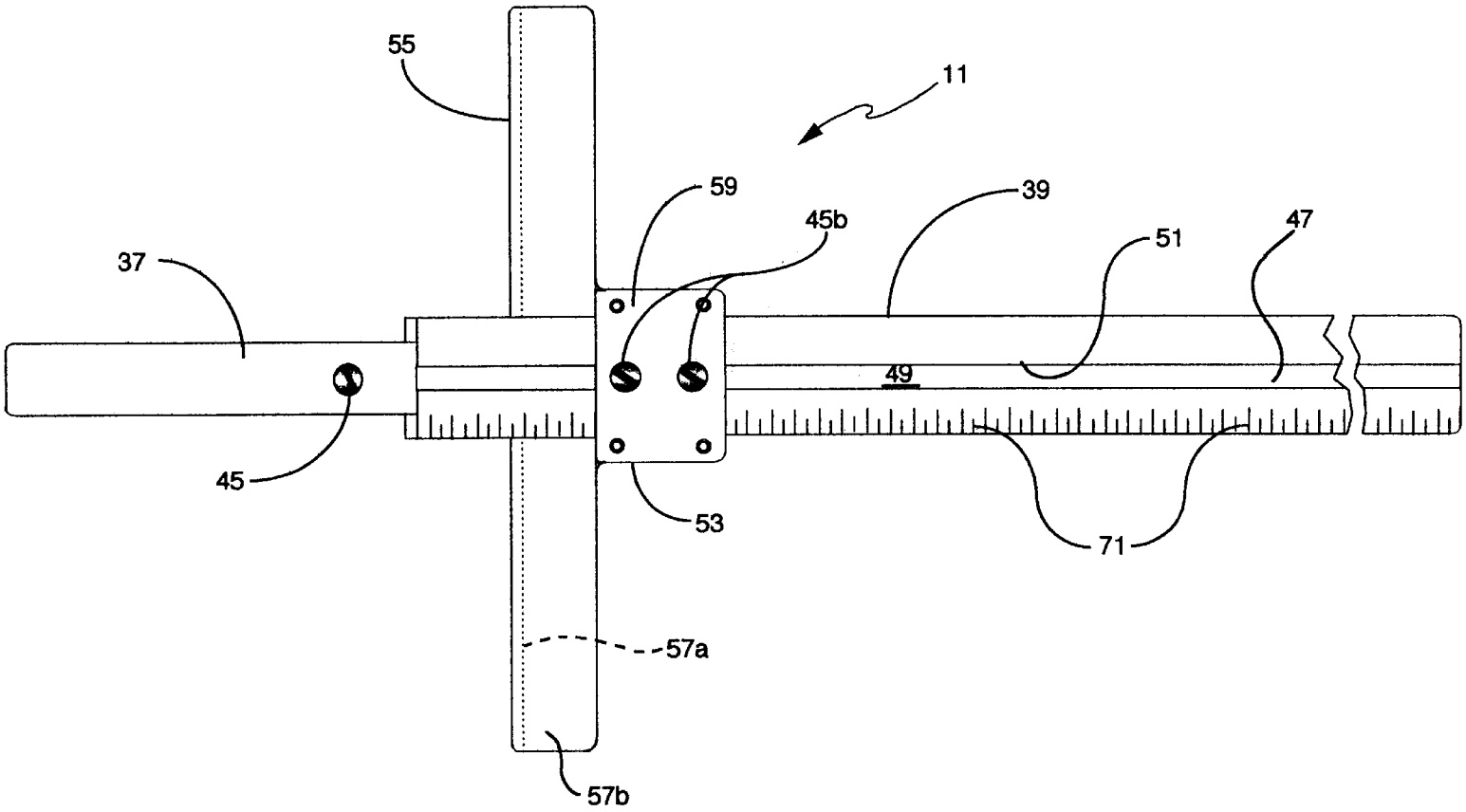
FIG. 5 is an elevation view of the guide shown in FIG. 2.

As best seen in FIGS. 2 and 5, the rip guide 11 preferably includes an elongated piece of flat bar stock which is stepped t a location intermediate its length to provide a flat upper section 37 and a flat lower section 39 of greater width. At the transition point therebetween, the bar stock is subjected to two 90° bends to create a transverse short wail section 41 that preferably lies perpendicular to the two sections 37 and 39 which lie in parallel planes. The upper section 37 is machined to have a width so as to be slidably, but snugly, received in the two channels provided by the center sections of the brackets 31. As seen in no. 1, when the rip guide is fully inserted into its operative location, the flat transition surface 41 abuts the lefthand straight edge 35 of the foot assembly. The vertical dimension of the transition surface is equal to the standard thickness of a saw foot assembly so that as seen in FIG. 3, the undersurface of the lower bar section 39 is coplanar with the undersurface of the foot assembly 25. At a location between the support bracket 27 nearest the lefthand edge 35 and the plane in which the saw blade 19 rotates, a tapped hole 43 is provided in the upper bar section 37 which receives a set screw 45. A similar tapped hole 43*a* is provided in the upper section 29 of the other bracket 31 Which receives a set screw 45*a*. Both tapped holes extend completely through the metal piece to allow the desired clamping force to be applied, as explained further hereinafter.

The lower, wider bar section 39 has a longitudinally extending groove 47, preferably of a rectangular cross-section, milled in its upper surface, which extends for the length of the bar section, as best seen in FIG. 2. The groove 47 has a bottom wall 49 and a pair of sidewalls 51, as best seen perhaps in FIG. 4. The groove extends in a straight line and is preferably located on the center line of the bar section 39. Slidably mounted on the lower bar section 39 is a guide member 53 which includes means that defines a straight line for abutment with the edge of the workpiece W being cut or trimmed. Preferably, the guide member 53 is formed with a flat surface 55 that is oriented preferably perpendicular to the flat bar section 39 (and thus essentially parallel to the plane of the transition section 41), which serves as the straight-line-defining means. In the illustrated embodiment, the guide member 53 is a section of angle iron which includes a narrow depending flange 57*a* and a wide flange 57*b*. The angle iron is machined so as to provide an extended central section in the wide flange that serves as the lower half of a holder that surrounds and is slidably movable along the length of the lower bar section 39.

Figure 4:
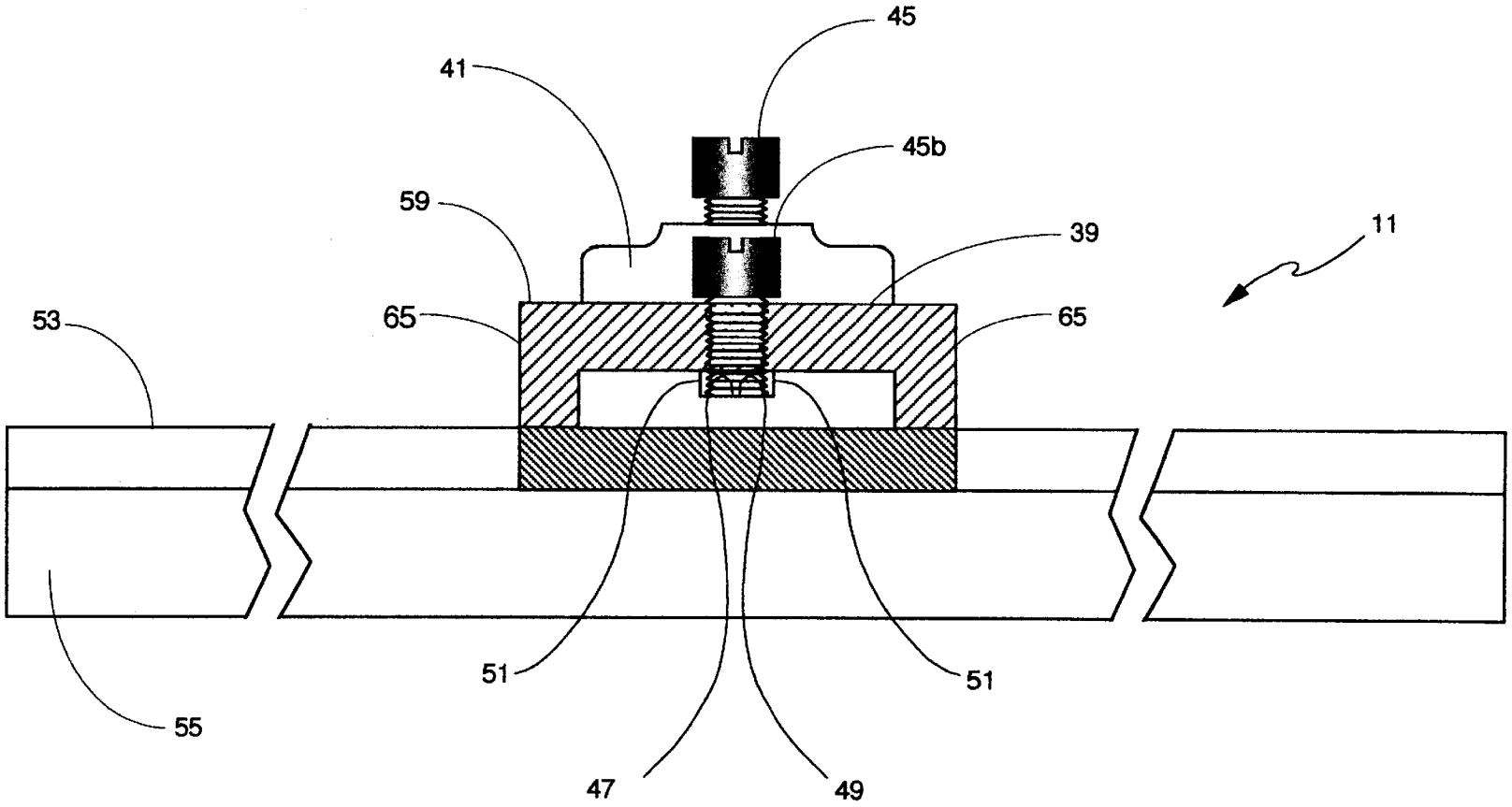
FIG. 4 is a section view of the guide taken generally along line 4—4 of FIG. 1.

More specifically, an upper holder section 59 is machined from a block of metal to provide an interrupted slot in its undersurface that creates a depending lug 63 that is very carefully proportioned so as to precisely interengage with the central rectangular cross-section groove 47, fitting snugly between its sidewalls, and closely flanking the side edges of the lower bar section 39 so there is essentially no play inbetween. As a result, the flat front surface 55 is precisely perpendicular to the longitudinal axis in the bar section 39 (which is defined by the section line 3—3 in FIG. 2). As best seen in FIG. 4, the upper section 59 of the holder has its undersurface machined with an interrupted or notched slot so as to provide an E-shape profile wherein a pair of outer legs 65 have interior surfaces that are spaced apart a few thousandths of an inch greater than the width of the lower bar section 39. The slot has a depth that is just slightly deeper than the thickness of the bar section 39 so as to fit in surrounding relationship about the profile of the bar section. This slot, which is milled in the undersurface of the holder 59, has a flat top wall except for the central interruption where the shallow depending lug 63 is positioned that is precisely machined to fit within the dimensions of the rectangular slot 47 in the upper surface of the bar member 39. The upper holder section 59 is affixed to the upper surface of the extension portion of the flange 57*b* in any suitable manner, as by welding, pinning, riveting or the like. In the illustrated embodiment, four countersunk cap screws are used. A pair of tapped holes 43*b* are provided which extend completely through the upper holder section 59 in the region of the lug 63, which accommodate a pair of similar set screws 45*b*.

Preferably, scale markings 71 are provided along one edge of the upper surface of the bar member 39, which will allow the user to set a precise dimension for the width of the strip of material being cut or trimmed from the workpiece. So long as the circular saw being employed is built to industry standard, i.e. so that the distance between the lefthand edge 35 of the foot assembly and the plane of the rotating blade 19 is the standard distance, the scale can be marked, if desired, so as to indicate the width of the strip that will be cut, based upon the location of either the front edge or the rear edge of the holder section 59 along the scale.

Utilization of the rip guide 11 is a simple and straightforward operation. The narrow flat upper bar section 37 is slid through the channels provided by the two brackets 27 (see FIGS. 1 and 3) so that the transition section 41 tightly abuts the lefthand edge of the foot assembly 25. Once in position, tightening of the set screws 45 and 45*a* very effectively clamps the bar 37 to the foot assembly 25. More specifically, the action of the set screw 45*a* presses the bar 37 tightly against the upper surface of the foot assembly 25, while the tightening of the set screw 45 raises the bar ever so slightly, forcing its upper surface into tight engagement with the undersurface of the bracket 27. This dual action provides extremely effectively clamping and assures the precision of the alignment of the rip guide with the lefthand edge of the foot assembly 25.

The guide member 53 is then carefully slid along the bar 39 until the plane of the flat surface 55 is exactly positioned a desired distance from the plane of the circular saw blade 19 that will cut the kerf K in the workpiece W. Once this location has been determined, the set screws 45*b* are both tightened, causing them to seat against the bottom surface 49 of the groove 47. Because the lug 63 is machined so as to precisely fit within the sidewalls 51 of the rectangular groove 47, the alignment of the perpendicular surface 55 is at precisely 90° to the longitudinal center line of the groove (see FIG. 5). The force of the set screws 45*b* against the bottom wall 49 causes the holder to be slightly raised bringing the upper surface of the extension of the flange 57*b* into tight engagement with the abutting flat undersurface of the bar 39, and establishing a precise and rigid positioning of the holder (and thus the guide member 53) along the length of the lower bar section 39. The slightly greater thickness of the extended section provides a slight gap below the foot assembly (see FIG. 3) that allows for nominal tolerances and small imperfections therein.

The handheld circular saw 13 with the rip guide 11 installed is then positioned upon the upper surface of a workpiece W to be cut or trimmed as shown in FIG. 1. The operator will begin at one end edge of the workpiece W with the foot assembly 25 resting flat upon the upper surface of the workpiece and aligned so that the flat surface 55 of the guide member is flush against the lefthand edge of the workpiece. Thereafter, when the operator actuates the trigger and slowly moves the circular saw along the length of the workpiece, maintaining the guide member flush against the lefthand edge of the workpiece, a straight kerf K is cut, as illustrated in FIG. 1.

As can be seen, the rip guide 11 can be quickly and easily installed onto a circular saw having a pair of standard brackets 27. It is feasible to construct the rip guide 11 so as to permit the ripping of sheet workpieces, such as plywood, to predetermined widths up to about 12.5 inches. The stepped feature in the bar, which creates a transition surface that abuts against the lefthand edge of the circular saw foot assembly, provides an extremely precise arrangement which assures precise alignment of the bar with the axis of rotation of the circular saw blade. The coplanar alignment of the undersurfaces allows precise cutting of fairly wide pieces from a workpiece. As mentioned, the dual set screws 45, 45*a* that clamp the bar 37 to the foot assembly 25 of the circular saw precisely clamp the rip guide in place thereupon. The combination of the notched slot in the undersurface of the holder and the dual set screws 45*b* that extend through the notched portion of the holder 59 substantially eliminates any play in this region, thus assuring precision of alignment of the slidable flat guide surface 55 with the lefthand edge of the circular saw foot assembly and thus with the plane of rotation of the circular saw blade. Moreover, the installation of the rip guide 11 is such that it will not interfere with the user's making miter cuts.

Although the invention has been illustrated and described with regard to a preferred embodiment which constitutes the best mode presently known by the inventor for carrying out this invention, it should be understood that various changes and modifications, as would be obvious to one having ordinary skill in this art, may be made without departing from the scope of the invention which is defined in the claims appended hereto. For example, although the longitudinal member is preferably made from a single piece of bar stock that is subjected to two 90° bends to create the intermediate transition surface 41 that lies precisely perpendicular to the longitudinal axis of the bar, other suitable constructions might be employed; for example, the longitudinal bar might be made from two separate pieces of steel that are welded together or alternatively by welding an intermediate spacer section between upper and lower pieces of flat bar stock. Generally, any construction that would provide a flat plane surface, or the equivalent, oriented perpendicular to the longitudinal centerline would be suitable; it could even be milled (but not economically) from a solid piece of metal stock. However, the integral, bent bar stock embodiment is preferred as it is believed to provide superior stability and rigidity, and to facilitate manufacture, a thin shim may be used to increase the thickness of the angle iron flange 57*b* in the region of the extension. Likewise, the holder upper section 59 can be affixed to the horizontal upper surface of a portion of the guide member 53 in any suitable manner so that there is stability and rigidity. Moreover, although steel is the preferred material for strength and economy of cost, other suitable construction materials, e.g. aluminum, brass, etc. might be employed for some or all of the components.

Particular features of the invention are emphasized in the claims which follow.

What is claimed is:

1. A handheld circular saw which comprises:

a housing and foot assembly for positioning the saw on a workpiece to be cut, an electric motor disposed in said housing which includes a rotatable shalt, a circular saw blade attached to said shaft for cutting the workpiece, an adjustable guide removably attached to said foot assembly for precisely guiding cutting movement of said circular saw blade relative to an edge of the workpiece, said guide including a bar which is mounted parallel to the axis of said shalt, which bar is stepped at a location intermediate of its length to provide a flat upper section and a flat lower section which are aligned in a straight line, said flat lower section having a rectangular cross-section with upper and lower flat surfaces and flat side edge surfaces, and having a longitudinally extending groove formed therein which groove has a bottom surface, a holder which is slidably movable along said lower bar section, said holder including three interior surfaces that lie in close juxtanosition with said upper surface and both said side edge surfaces of said flat lower section, a guide member carried by said holder which includes means defining a straight line which can be slid along the workpiece edge, said holder and said flat lower section interengaging in a manner so that said means defining a straight line is maintained precisely perpendicular to said shaft axis; and said holder having a threaded hole extending therethrough and a clamping screw being threadably received in said hole so that a free end of said screw can be caused to tightly engage said bottom surface of said groove to precisely position said holder and its guide member at a desired longitudinal location along said bar; and means for removably mounting said flat upper bar section upon an upper surface of said foot assembly in a manner so that said bar is precisely parallel to said shaft axis.

2. The saw according to claim 1 wherein said bar is constructed of a single flat piece of metal that contains two 90° bends to create said intermediate step which is perpendicular to said flat upper section.

3. The saw according to claim 1 wherein a pair of said threaded holes are provided which are aligned along a longitudinal center line of said bar when said holder is slidably interengaged therewith.

4. The saw according to claim 1 wherein said guide member includes a flat plate, the upper surface of which flat plate is planar and parallel to the plane of the lower flat surface of said flat lower section, which plate is rigidly affixed to said holder.

5. The saw according to claim 4 wherein said flat plate has a 90° flange which constitutes said means defining a straight line that slides along the workpiece edge.

6. The saw according to claim 1 wherein said flat upper section has a rectangular cross-section and wherein said means for removably mounting means includes a pair of generally U-shaped channels which are affixed to an upper surface of said foot assembly and which slidably receive said upper bar section, and means for clamping said upper bar section to said foot assembly with said stepped region in engagement with a side edge of said foot assembly.

7. The saw according to claim 6 wherein said means for clamping includes two threaded clamping screws, one of which is received in a threaded hole extending through an upper surface of one of said channels and the other of which is received in a threaded hole extending through said flat upper section at a location, in its installed position, between said other channel and the plane of the circular saw blade.

8. An adjustable rip guide for use in combination with a handheld circular saw which includes a housing and foot assembly for positioning the saw on a workpiece to be cut, an electric motor disposed in said housing which drives a rotatable shaft, a circular saw blade attached to the shaft, and means for removably mounting an adjustable guide to the upper surface of said foot assembly, which guide comprises:

an elongated bar which interengages with the mounting means so as to be mounted parallel to the axis of the shaft, said bar being stepped at a location intermediate of its length to provide a flat upper section and a flat lower section which are aligned in a straight line, said flat lower section having a rectangular cross-section with upper and lower flat surfaces and flat side edge surfaces, said upper surface of said flat low section having a longitudinally extending groove which has a bottom surface formed therein, a holder which is slidably movable along said flat lower section, said holder including three interior surfaces that lie in close juxtaposition said upper surface and both said side edge surfaces of said flat lower section, a guide member carried by said holder which includes means defining a straight line which can be slid along the workpiece edge, and said holder having a threaded hole extending therethrough and a clamping screw being threadably received in said hole so that a free end of said screw can be caused to tightly engage said bottom surface of said groove to precisely position said holder and its guide member at a desired longitudinal location side said bar, said holder and said flat lower section interengaging in a manner so that said means defining a straight line is maintained precisely perpendicular to the shaft axis;

whereby when said upper bar section is removably mounted upon the upper bar surface of the foot assembly, said bar is precisely parallel to said shaft axis and said guide member precisely guides cutting movement of the circular saw blade relative to an edge of the workpiece.

9. The guide according to claim 8 wherein said bar is constructed of a single flat piece of metal that contains two 90° bends to create said intermediate step which is perpendicular to said flat upper section.

10. The guide according to claim 8 wherein a second such threaded hole is provided in said holder which two holes are aligned and spaced along a longitudinal center line of said bar when said holder is slidably interengaged therewith.

11. The guide according to claim 10 wherein said guide member includes a flat plate, the upper surface of which flat plate is planar and parallel to the plane of the lower surface of said flat lower section, and wherein said plate is rigidly affixed to said holder.

12. The guide according to claim 11 wherein said flat plate has an integral 90° flange which constitutes said means defining a straight line means that slides along the workpiece edge.

13. The guide according to claim 8 wherein said flat upper section is proportioned to interfit with a pair of brackets affixed to the upper surface of the foot assembly and has a rectangular cross-section and wherein a threaded clamping screw is provided in a threaded hole extending through said upper bar section at a location, in its installed position, between the brackets.

* * * * *